US008205396B2

(12) United States Patent
Atiyeh, Sr. et al.

(10) Patent No.: US 8,205,396 B2
(45) Date of Patent: Jun. 26, 2012

(54) FASCIA ASSEMBLY FOR ROOF EDGE CONSTRUCTION

(76) Inventors: George Atiyeh, Sr., Allentown, PA (US); George Atiyeh, Jr., Allentown, PA (US)

( * ) Notice: Subject to any disclaimer, the term of this patent is extended or adjusted under 35 U.S.C. 154(b) by 0 days.

(21) Appl. No.: 12/925,788

(22) Filed: Oct. 29, 2010

(65) Prior Publication Data

US 2012/0102848 A1 May 3, 2012

(51) Int. Cl.
*E04D 3/38* (2006.01)
*E04C 2/38* (2006.01)

(52) U.S. Cl. ..... 52/60; 52/96; 52/300; 52/718.06

(58) Field of Classification Search ..... 52/58, 60, 52/97, 96, 300, 718.06, 718.03; 403/331
See application file for complete search history.

(56) References Cited

U.S. PATENT DOCUMENTS 1,953,867 A * 4/1934 Ramey et al. ..... 52/61
2,195,068 A * 3/1940 Wiley ..... 52/718.06
2,974,448 A * 3/1961 Weis ..... 52/60
3,533,201 A * 10/1970 Tyler ..... 52/60
3,925,952 A * 12/1975 Hagel et al. ..... 52/714
4,483,112 A * 11/1984 Rueblinger ..... 52/94
4,648,218 A * 3/1987 Butzen ..... 52/96
4,780,999 A * 11/1988 Webb et al. ..... 52/96
5,189,853 A * 3/1993 Braine et al. ..... 52/96
5,927,023 A 7/1999 Kittilstad
6,216,408 B1 4/2001 Davidson
6,578,322 B2 6/2003 Kintop
6,912,814 B1 7/2005 Inzeo et al.
7,104,013 B1 * 9/2006 Gates et al. ..... 52/96
7,451,572 B1 11/2008 Inzeo et al.
7,748,173 B1 * 7/2010 Inzeo et al. ..... 52/60
2002/0108327 A1 * 8/2002 Shaw ..... 52/211

* cited by examiner

*Primary Examiner* — Robert Canfield
*Assistant Examiner* — Brent W Herring
(74) *Attorney, Agent, or Firm* — Sanford J. Piltch

(57) ABSTRACT

A combination fascia cover system is provided including a base plate having a shorter portion for lying atop the roof edge and a longer portion at right angles to the first portion for overlying the upper sidewall and being attached thereto by threaded fasteners through a series of holes perforating the longer portion. The shorter portion of the base plate having, at its distal end, an upwardly extending flange for creating an upward spacing away from the roofing system and at end of the flange a partially reinforced pocket is formed by overlying folds to form the pocket. The cover plate is mounted over the base plate with a spring clip having uniquely spaced bends configured to match the dimensions of the base and cover plates, which spring clip engages the pocket, the base plate and the cover plate to retain the base and cover plates in tensioned spaced relationship while engaged together with one another.

7 Claims, 3 Drawing Sheets

FASCIA ASSEMBLY FOR ROOF EDGE CONSTRUCTION

BACKGROUND OF THE INVENTION

The present invention resides in the field of metal fascia dimensioned and configured to overlie the roof edge of a built-up or flat roof. The apparatus may be described as a base plate having a shorter portion for lying atop the roof edge and a longer portion at right angles to the first portion for overlying the upper sidewall and being attached thereto by the use of threaded fasteners through a series of holes perforating the longer portion. A cover fascia plate is attached to flanges at the upper and lower portions of the base plate and held at tension upward and outward from the base plate by a spring clip uniquely positioned between the base plate and the fascia cover.

Large rubber membranes and the like are commonly used for covering a roof such as a flat roof. The membrane is laid over the surface of the roof and secured in place by adhesive and/or mechanical fastening means. A number of prior mechanisms have been developed for securing the edges of a rubber roof membrane in place along the edge of the roof in order to maintain the roofing membrane in position in proximate contact with the underlying roofing support surface. In some applications the rubber membrane may be subjected to significant wind forces causing the rubber membrane to tend to pull away from the surface of the roof. The edge of the roof is especially susceptible to damage from wind shear forces, and, if the edge of a rubber roof membrane were to become detached from the roof, all or a substantial portion of the membrane may be blown off. Moreover, damage often occurs from water entering the building structure, for example by flowing over the edge of the roof and down an outside wall where it may enter the structure and cause damage to the building.

Generally, an upwardly extending water dam is mounted at the edge of the roof and a fascia is mounted over the water dam. The fascia generally also extends downward, parallel to the outside wall of the building. The fascia improves the appearance of the roof edge and further increases resistance to wind-driven rain and wind uplift loads along the roof edge. Unfortunately, existing systems often require non-standard water dams and/or edge fascia which are comprised of a number of complicated parts that are difficult and time consuming to install.

One generally accepted roof edge systems are described in U.S. Pat. Nos. 6,912,814 and 7,451,572 [Inzeo, et al.] that shows a roof edge clamping system for overlying the roofing membrane, clamping it down and providing a metal fascia at the roof edge to hide the bolts and plates of the clamping members. This system relies entirely upon fasteners to retain the cover in position and does not protect for the vertical penetration of water behind the fascia.

Another system, one that utilizes a type of spring clip to force the roof edge metal fascia upward, is described in U.S. Pat. No. 6,578,322 [Kintop]. This system requires both a catch and the spring clip to operate properly and maintain the fascia in the required position. This system is complex to manufacture and just as complex to install on a rooftop. Based upon the number of metal plates, the required bends and folds, and the interrelationships of the various plates and folds, the complex system requires particular attention to positioning on installation. The cover overlying the fastener holding the spring clip in place suffers from the probability of releasing from wind shear along the roof surface without another fastener holding it in position.

Still another edge fascia system using a spring clip is described in U.S. Pat. No. 5,927,023 [Kittilstad]. The Kittilstad system also depends upon a spring clip positioned between the top outward facing corner of the cover and a ridge formed along the inner rear side of the base over which the outer cover plate also fits. This system is subject to probable failure in the event that there is sufficient wind lift and the cover plate lifts away from the base plate ridge or if the cover plate is subjected to sufficient distortion due to damage or careless placement of ladders or walking along the roof edge.

The two roof edge systems using the spring clip both rely upon the cover plate fitting over and holding the spring clip in place. However, the cover plate is not held down and is the second piece of metal curling around or over a raised portion of the base plate that is the sole retaining mechanism for the cover along the entire expanse of the roof edge system. This type of system suffers from the deficiencies noted above with neither system taking full advantage of a spring clip that force the cover plate away from the base plate when fully assembled.

It is, therefore, an object of the present invention to overcome the previous deficiencies by using a differently positioned spring clip that forces the parts of the roof edge system away from each other, and then retains those parts in that orientation. It is a further object of the present invention to reduce the required time to install the spring clip type roof edge systems by housing the spring clip in a different fold or retaining space that that over which the cover plate is placed. It is yet an additional object to provide a spring clip that produces sufficient upward force to retain the top outer edge of the cover at its farthest outward and upward extent at all times, once fully installed. It is a still further object of the present invention to reduce the time and complexity of installation of the roof edge fascia system through the reconfiguring of the attachment points for the spring clip and cover plate. Other objects will appear hereinafter.

SUMMARY OF THE INVENTION

The present invention provides a superior roof edge fascia system for securing the periphery of a membrane to the edge of a roof so that the membrane remains securely fastened to and against the surface of the roof and will not pull up as a result of wind forces on the membrane. Specifically, the present invention provides a base plate having a shorter portion for lying atop the roof edge and a longer portion at right angles to the first portion for overlying the upper sidewall and being attached thereto by the use of threaded fasteners through a series of holes perforating the longer portion. The shorter portion of the base plate has, at its distal end, a pocket formed from overfolding the edge of the distal end at the uppermost region of an upstanding end portion of the base plate creating an upwardly distanced spacing away from the roofing system. The pocket is formed by the overlying of the edge turned inward and against the inner upper wall of the pocket, but only partially along the pocket depth. The pocket is dimensioned to receive a spring clip that is specially bent or folded at desired spacings so as to fit within the pocket and extend outward and upward to contact the inner side of the fascia cover plate at the approximate 90° fold point at the juncture of the horizontal and vertical legs of the cover supporting it in general parallelity to the base plate in both dimensional directions.

At the distal end of the longer portion of the base plate an outwardly angled edge is formed for attaching the other end of the cover plate. The cover plate is dimensioned slightly larger than the base plate with a 90° bend between its shorter and longer portions approximating the same lengths from the bend in the base plate for each of the portions of the cover plate. The cover plate is held in position by bent edges that overlie the lower outwardly angled edge of the base plate and the inward facing edge of the pocket at the distal edge of the shorter portion of the base plate and supported in position by the properly positioned and located spring clip mounted within the pocket.

Within the open space created by the pocket located at the shorter end edge of the base plate, and in order to maintain tension between the base and cover plates when mounted by exerting a force upward and outward from the 90° bend in the base plate to retain the cover plate in an extended support relationship, a plurality of spring clips are placed at predetermined locations along the extent of the fascia cover and base plates. The spring clip is formed in a relaxed S-shape with an elongated lower end extending and pushing into the formed pocket in the space remaining in the pocket depth beyond the reinforcing overfold of the end edge. The elongated lower end of the spring clip has a series of partial punched outward extensions such that as the end is inserted into the pocket of the base plate the spring clip is retained in position within the pocket so that it will extend forward, upward and outward to provide support for the interior of the bend in the cover plate. The spring clip, at its first bend, leaves the pocket and extends downward to the top of the base plate contacting the base plate approximately midway along the shorter portion. A second bend extends the spring clip upward toward the interior of the cover plate, but short of the inner side of the cover a reinforcing bend extends the spring clip outward toward the corner of the cover plate. A fourth bend in the spring clip contacts the interior of the cover plate at approximately an equidistant point on either side of the 90° bend to the distal end of the spring clip on the other side of the 90° bend. The spread of the two contact points add strength by providing a greater space between contact points and the contact point of the spring clip against the top side of the base plate provides a more stable support for the cover fascia corner while remaining unmovingly anchored in the pocket.

The cover plate is mounted over the base plate and spring clip by engaging its lower portion bent edge over the lower portion outward angled edge of the base plate and then pushing the spring clip rearward into the pocket of the base plate the second bent edge of the cover plate is engaged with the upward angled edge of the base plate by slipping the edges over one another compressing the spring clip, and then permitting the spring clip to expand and force the cover plate outward away from the base plate retaining both edges in engagement. The foregoing and other features of the invention are hereinafter fully described and particularly pointed out in the claims, the following description and drawings setting forth by way of illustration and example the preferred embodiments of this invention.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
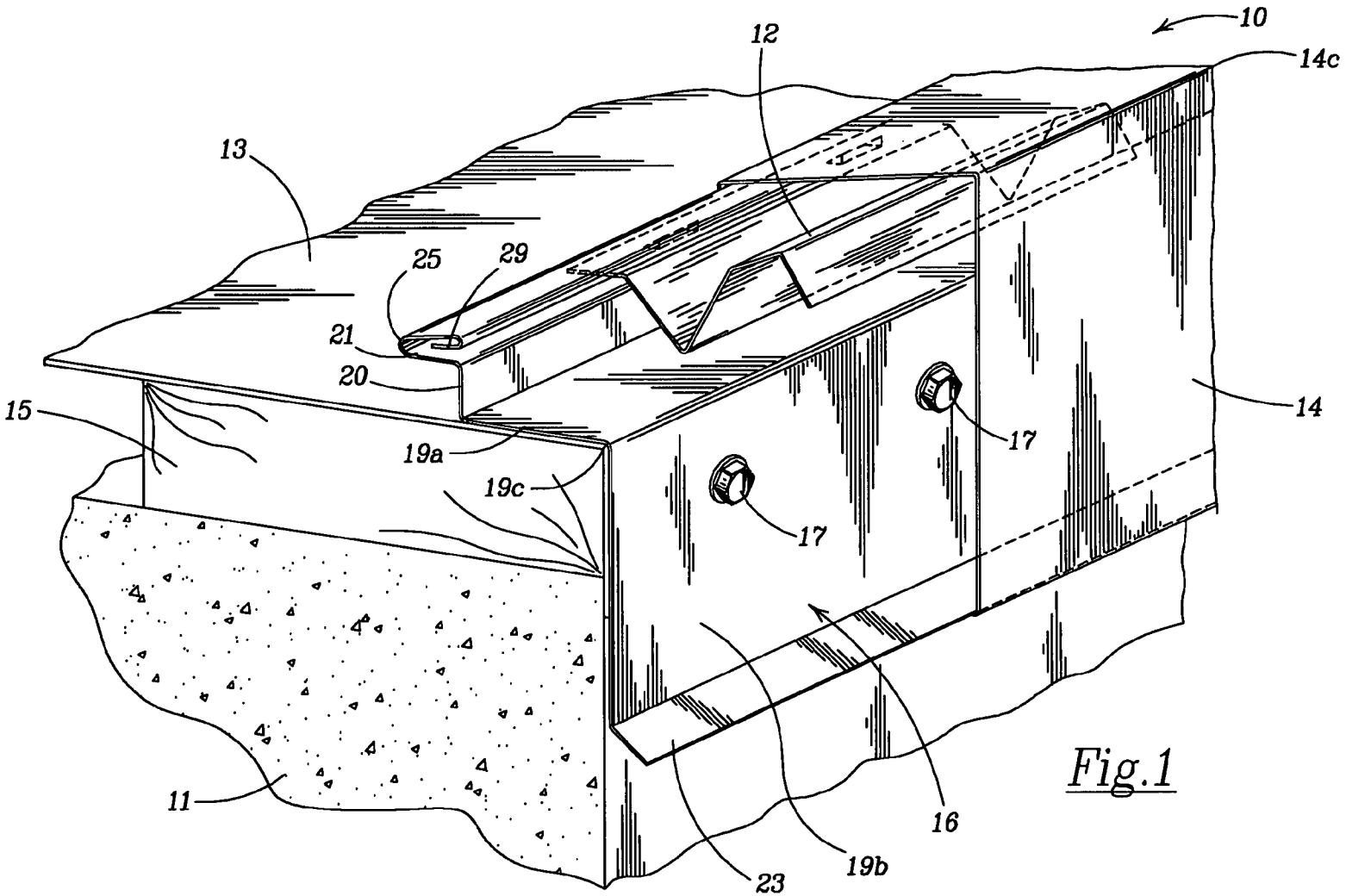
FIG. 1 is a perspective partial cutaway view of the fascia assembly of the present invention showing the S-shaped spring clip for maintaining an outward extension force against the fascia cover plate.

With reference now to the drawing figures in which like-reference numerals designate like parts throughout the disclosure, the fascia assembly system of the present invention is illustrated generally at 10 in FIG. 1 having an S-shaped spring clip 12 for maintaining an outward extension force against a cover plate 14. The system 10 is secured to a building having a number of sidewalls and a roof. The system 10 is designed to be secured to the building at the intersection or joining of the wall 11 and the roof, including roofing membrane 13, in order to provide a superior fascia system for securing the periphery of the membrane 13 to the edge of a roof, along the upper expanse of the wall 11, so that the membrane 13 is securely fastened to and against the surface of the roof and will not pull up as a result of wind forces on the membrane 13.

Figure 2:
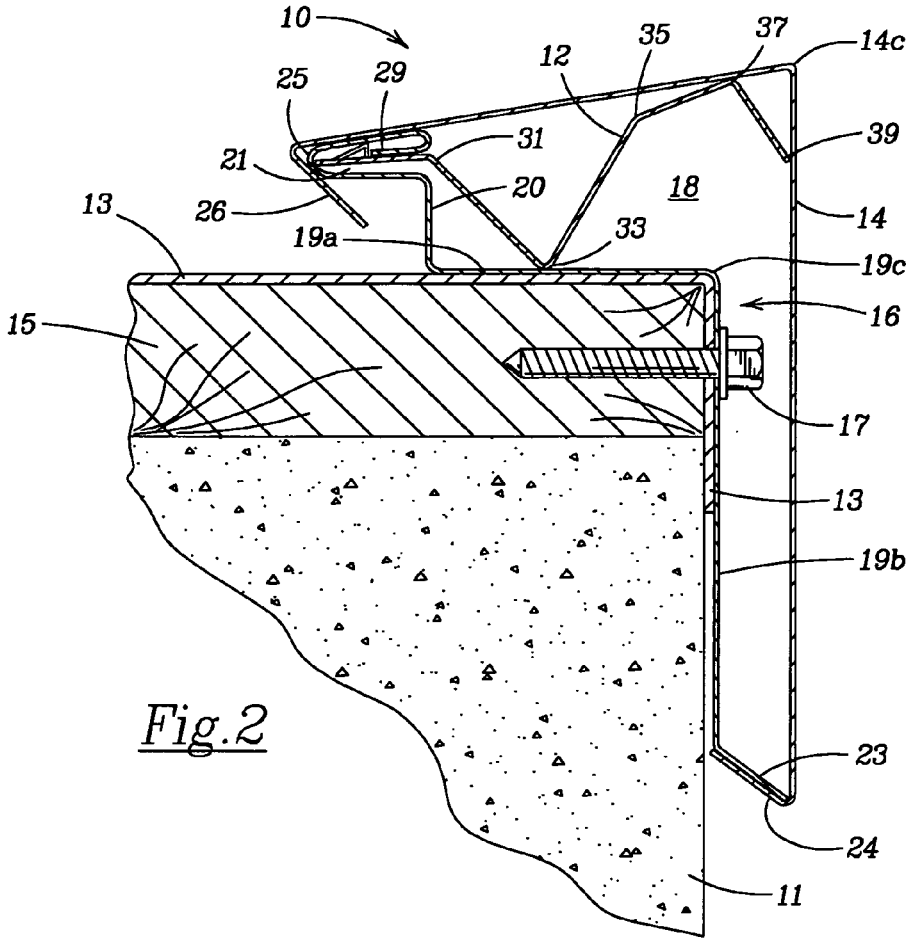
FIG. 2 is a cross-sectional view of the fascia assembly of the present invention showing the functional interrelationship of the bottom plate, cover plate and spring clip.

Referring to FIG. 2, the fascia assembly 10 creates a functional interrelationship between and among a base plate 16, the cover plate 14 and spring clip 12. The base plate 16 is bent at right angles such that there results a shorter portion 19*a* for lying atop the roof edge and a longer portion 19*b* at right angles to the shorter portion 19*a* for overlying the upper portion of the sidewall 11. The longer portion 19*b* of the base plate 16 is attached to the upper portion of the wall 11 by the use of threaded fasteners 17 through a series of holes perforating the longer portion 19*b* and extending into the top portion of the wall 11. As shown in FIG. 2, the top portion of the wall 11 consists of a cover plate 15 made of lumber such that the fasteners 17 extend through the base plate 16 and into the wooden cover plate 15 at the top of wall 11. Other materials can be used to cap the vertical wall 11, and the type of fasteners used would be selected to mount the base plate 16 to the material used at the top of the sidewall 11.

The shorter portion 19*a* of the base plate 16 has, at its distal end, an upwardly extending flange 20 with a horizontally oriented pocket 21 at its uppermost extent. In the example shown, the pocket 21 is positioned entirely inward away from the wall 11, but the pocket 21 may be made to be closer to the wall 11 so long as there remains an inward facing bend 23 over which the cover plate 14 can be placed.

The pocket 21 is formed by bending the upward extending flange 20 such that a lower first section extends away from the junction of the shorter and longer portions 19*a*, 19*b*, respectively, of the base plate at the 90° bend 19*c*. The flange is then folded back over itself to form equal length portions with the inward edge of the overfolded section forming an edge within the pocket 21. The overfolded edge extends partway back into the fold as both a reinforcement against the expansion of the pocket 21 and to serve as a block against the easy removal of the spring clip 12 once inserted into the pocket 21. The pocket 21 is finally formed by folding the reinforced edge downward over the lower section with the pocket opening facing toward the base plate junction 19*c*. In this manner the pocket 21 is formed by folding the inward facing edge of the base plate 16 and creating an upward spacing by means of flange 20 away from the shorter portion 19*a* of the base plate and the membrane 13 of the roofing system to create a separation for the spring clip 12 of the present edge fascia system and to accommodate a location for the attachment of cover plate 14.

The pocket 21 is dimensioned to receive the spring clip 12 that is specially bent or folded at desired spacings, to be described more fully below, so as to fit within the pocket and extend outward and upward to contact the inner side of the fascia cover plate 14 at the approximate 90° fold point at the juncture of the horizontal and vertical legs of the cover plate 14 supporting it in general parallelity to the base plate 16 in both horizontal and vertical dimensional directions. In this way the properly positioned and located spring clip 12, with one end mounted within the pocket 21, retains the cover plate 14 in position away from the base plate 16 as described more fully below.

At the distal end of the longer portion 19*b* of the base plate 16 an outwardly angled edge 23 is formed for attaching the lower end 24 of the cover plate 14. The cover plate 14 is dimensioned slightly larger than the base plate 16 with a 90° bend between its shorter and longer portions approximating the same lengths from the bend in the base plate 16 for each of the portions of the cover plate 14. The cover plate is held in position by bent edges 24, 26 that overlie the lower outwardly angled edge 23 of the base plate 16 and the rearward facing bend 25 of the pocket 21 at the distal edge of the shorter portion 19*a* of the base plate 16, respectively. The bent edge 26 of the cover plate 14 has sufficient length to extend completely over the bend 25 and extend farther downward toward the roof membrane 13 within the space afforded outside the flange 20.

Within the open space that is created the cover plate 14 and the base plate 16, and in order to maintain tension between the cover and base plates 14, 16 when mounted by exerting a force upward and outward from the 90° bend in the base plate 19*c* to retain the cover plate 14 in an extended support relationship, a plurality of spring clips 12 are placed at predetermined locations along the extent of the fascia cover and base plates 14, 16. The spring clip 12 is formed in a relaxed S-shape with an elongated first end 30 extending and pushing into the formed pocket 21 in the space remaining in the pocket depth beyond the reinforcing overfold of the end edge. The elongated first end 30 of the spring clip 12 has a series of partial punched outward extensions 28 such that as the end of the spring clip 12 is inserted into the pocket 21 located at the distal end of the shorter portion 19*a* of the base plate 16 the spring clip 12 is retained in position within the pocket 21 by the punched extensions 28 engaging the overfolded edge 29 of the pocket 21. The engaging of the punched extensions 28 with the overfolded edge 29 locks the spring clip 12 in position so that it will extend forward, upward and outward to provide support for the interior of the corner bend of the cover plate 14.

Figure 3:
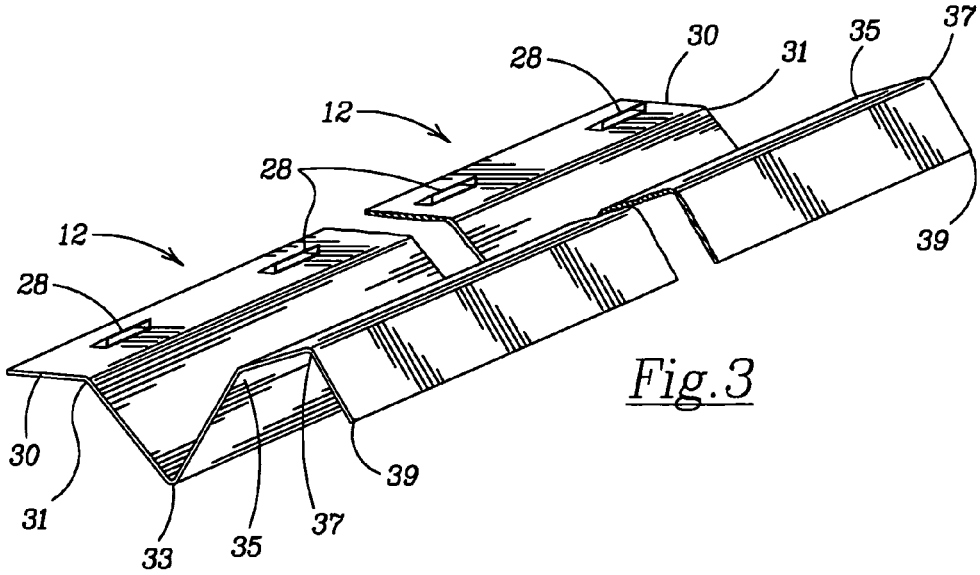
FIG. 3 is an isometric view of a plurality of spring clips for use with the present invention arrayed in a side-by-side alignment.

With reference to FIG. 3, the spring clip 12, at its first bend 31, leaves the pocket 21 and extends downward toward the base plate 16, contacting the base plate 16 approximately midway along the shorter portion 19*a*. A second bend 33, acting as a fulcrum point, extends the spring clip 12 upward toward the interior of the cover plate 14, but short of the inner side of the cover plate 14 a third or reinforcing bend 35 extends the spring clip 12 outward toward the interior of the corner bend of the cover plate 14. A fourth bend 37 in the spring clip 12 contacts the interior of the cover plate 14 at approximately a point equidistant from the 90° corner bend of the cover plate 14 as the distal end 39 of the spring clip 12 on the other side of the 90° corner bend. The spread of the two contact points 37, 39 of the spring clip 12 adds strength to the system by providing a greater space between the contact points of both the cover plate 14 and of the spring clip 12. The fulcrum point bend 33 of the spring clip 12 contacting and pushing against the upward facing side of the base plate 16 provides a more stable support for the spring clip 12 providing the force required for retaining the cover plate 14 and fascia corner 14*c* in a fully extended position while remaining unmovingly anchored in the pocket 21.

Referring again to FIGS. 1 and 2, at the distal end of the longer portion 19*b* of the base plate 16 is an outwardly angled edge 23 is located for attaching an inwardly angled end 24 of the cover plate 14, which end of the cover plate 14 is angled similarly to, so as to mate with the outward angle of the distal edge 23 of the base plate 16. The other end 26 of the cover plate 14 is also angled inwardly to overlie the inward extending exterior surface 25 of the pocket 21 at the upper end of the flange 20 along the distal edge of the shorter portion 19*a* of the base plate 16. The cover plate 14 is mounted over the base plate 16 and spring clip 12 by engaging the lower portion bent edge 24 of the cover plate 14 over the outwardly angled edge 23 of the lower portion 19*b* of the base plate 16 and then compressing the spring clip 12 rearward toward the pocket 21 of the base plate 16 so that the second angled edge 26 of the cover plate 14 fits over and catches the rearward edge 25 of the exterior of the pocket 21 at the height of the flange 20 at the distal end of the shorter portion 19*a* of the base plate 16.

The cover plate 14 is dimensioned slightly larger than the base plate 16 with a 90° bend between its shorter and longer portions 19*a*, 19*b* approximating the same lengths from the bend in the base plate 16 for each of the portions of the cover plate 14. Within the space 18 created between the cover plate 14 and the base plate 16 the spring clip 12 extends as described above from the pocket 21 toward the fascia corner 14*c* of the cover plate 14 exerting a force upward and outward from its fulcrum point 33 along the base plate 16 to retain the cover plate 14 in an extended tensioned spatial relationship.

Figure 4:
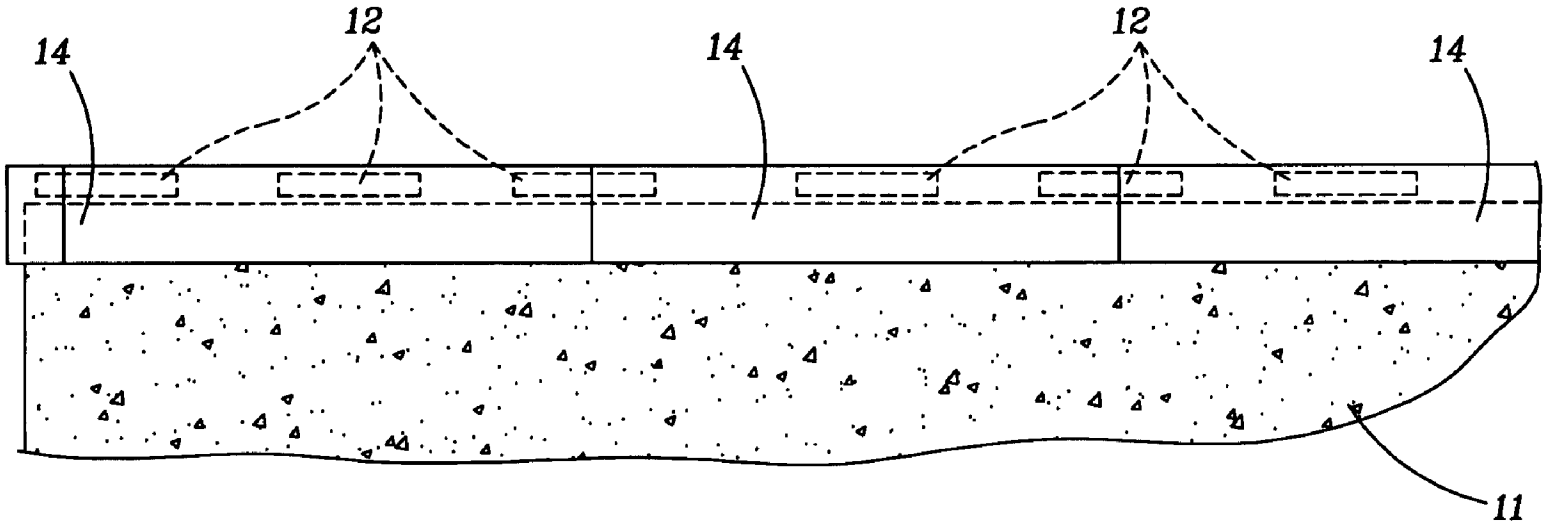
FIG. 4 is a front view of the fascia assembly of the present invention at the roofline showing the approximate spacings of the plurality of spring clips for use along a length of overlapping fascia cover plates.

FIGS. 3 and 4 show a plurality of spring clips 12, arrayed in side-by-side relationship, for use with the present invention. The rearward portions 30 of the spring clips 12 have a series of partially punched outwardly extending protrusions 28 such that as the end 30 of the spring clip 12 is inserted into the pocket 21 of the base plate 16, the spring clip 12 is retained in position by the protrusions 28 extending upward beyond the edge 29 of the reinforcing fold of the pocket 21 so that the spring clips 12 cannot be easily withdrawn from the pocket 21. Retained in this manner, the spring clip 12 will extend forward, upward and outward to provide support for the interior of the 90° bend at the outer corner 14*c* of the cover plate 14.

Referring now to FIG. 4 there is shown the fascia assembly 10 at the roofline showing the approximate spacings of the plurality of spring clips 12 (in dashed lines) arrayed along a series of overlapping fascia cover plates 14. The spring clips are positioned at the joints and at internal spacing to support the cover plates 14 at points where the outer integrity of the cover plates 14 in rejecting the penetration of moisture is critical, or to provide uniform support across the entire length of the cover plate 14. In this manner both joints between fascia cover plates and the midpoints of the cover plates 14 are fully supported with the outward force of the spring clips 12 creating the outward tension force to retain the cover plates 14 in proper alignment for the edge fascia roofing system 10 to function as intended.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A covering fascia system for roof edge construction comprising:

a base plate having a shorter portion for lying atop the roof edge and a longer portion joined at right angles to the shorter portion for overlying the upper portion of the sidewall;

fastening means for attaching said base plate to the upper portion of said sidewall through laterally spaced openings arrayed along the length of the baseplate;

said base plate having, at the distal end of the shorter portion, an upstanding flange having at its topmost a series of folds forming a pocket having an opening facing toward the junction between the shorter portion and the longer portion of said baseplate creating a space therebetween to accept and retain an S-shaped spring clip;

said S-shaped spring clip extending outward from said pocket contacting the baseplate at an approximate midpoint along the length of the shorter portion and extending upward and outward to span the corner joint of a cover plate overlying the baseplate and connected thereto at the furthest ends of the baseplate from the joint between the shorter and longer portions to retain the cover plate in a forward and upwardly extended, tensioned position, said S-shaped spring clip being formed by a first bend oriented downward as said spring clip exits the pocket, an upward second bend at the point of contact of the spring clip with the base plate, a forward reinforcing third bend partway to the corner joint of said cover plate, and a fourth bend for spanning the corner joint of the cover plate from the contact point of the fourth bend to the distal end of the spring clip at contact points on the cover plate approximately equidistant on either side of said corner joint.

2. The covering fascia system of claim 1, wherein said pocket in the baseplate is dimensioned to accept and retain the S-shaped spring clip.

3. The covering fascia system of claim 1, wherein said pocket being formed by the overfolding of the distal end of the shorter portion of the base plate by folding a first predetermined length of said portion back over the length of the shorter portion of the base plate and then folding a second predetermined length under the first folded length, but shorter than the first folded length to create a space in which to capture said S-shaped spring clip.

4. The covering fascia system of claim 1, wherein the spring clip is further comprised of a plurality of partial punched extensions along its upper surface for engaging the edge of the second folded length of the base plate within the formed pocket to retain the inserted spring clip within the pocket.

5. The covering fascia system of claim 1, wherein the distal ends of the base plate form anchor points for the cover plate, said anchor points being cooperatively angled extensions over which the distal ends of the cover plate fit over and fully engage to lock the fascia system together.

6. The covering fascia system of claim 1, wherein the longer portion of the base plate being angled outward to accept and lockingly engage with an inwardly angled cooperating end portion of the cover plate.

7. The covering fascia system of claim 1, wherein the shorter portion of the base plate, at the rearmost portion of the formed pocket provides an extension to accept and lockingly engage with an inwardly angled cooperating end portion of the cover plate.

* * * * *